US011779511B2

(12) United States Patent
Cheong

(10) Patent No.: US 11,779,511 B2
(45) Date of Patent: Oct. 10, 2023

(54) MASSAGE APPARATUS

(71) Applicant: CONAIR CORPORATION, Stamford, CT (US)

(72) Inventor: Yeung Shun Cheong, Hong Kong (HK)

(73) Assignee: Conair LLC, Stamford, CT (US)

( * ) Notice: Subject to any disclaimer, the term of this patent is extended or adjusted under 35 U.S.C. 154(b) by 138 days.

(21) Appl. No.: 16/688,271

(22) Filed: Nov. 19, 2019

(65) Prior Publication Data

US 2021/0145689 A1 May 20, 2021

(51) Int. Cl.
*A61H 15/00* (2006.01)

(52) U.S. Cl.
CPC . *A61H 15/0085* (2013.01); *A61H 2015/0014* (2013.01); *A61H 2201/0153* (2013.01); *A61H 2205/106* (2013.01)

(58) Field of Classification Search
CPC ..... A61H 15/00; A61H 15/0078; A61H 15/0085; A61H 15/0092; A61H 2015/0007; A61H 2015/0014; A61H 2015/0028; A61H 23/00; A61H 23/0254; A61H 2015/0071
See application file for complete search history.

(56) References Cited

U.S. PATENT DOCUMENTS 2,219,138 A * 10/1940 Morrison ..... A61H 15/0078 601/125
5,123,406 A * 6/1992 Masuda ..... A61H 23/0263 601/72
5,997,489 A * 12/1999 Iwamoto ..... A61H 15/0092 601/73
6,022,328 A 2/2000 Hailey
6,053,881 A 4/2000 Boodramsingh et al.
6,241,693 B1 6/2001 Lambden
D452,572 S 12/2001 Nakamura
D456,909 S 5/2002 Szabo
D491,271 S 6/2004 Siegried
D556,336 S 11/2007 Talbot et al.
D613,416 S 4/2010 Schupman
D688,380 S 8/2013 Nelson
D793,571 S 8/2017 Iurchenko
9,717,641 B2 8/2017 Ky
(Continued)

FOREIGN PATENT DOCUMENTS

CN 107714421 A 2/2018

OTHER PUBLICATIONS

International Search Report dated Feb. 4, 2021 from corresponding International Patent Application No. PCT/JS2020/059266, 2 pages.
(Continued)

*Primary Examiner* — Colin W Stuart
*Assistant Examiner* — Douglas Y Sul
(74) *Attorney, Agent, or Firm* — Ruggiero McAllister & McMahon LLC

(57) ABSTRACT

A massaging apparatus has a generally U-shaped housing with a central segment pivotably connected at a first end to a distal end of a first side segment and at a second end to a distal end of a second side segment. The segments are spring biased at their connections and the massaging apparatus includes rotatably mounted rollers that can spin when the apparatus is applied to a body part and a motor that vibrates when energized.

9 Claims, 6 Drawing Sheets

(56) References Cited

U.S. PATENT DOCUMENTS

| | | | | |
|---|---|---|---|---|
| D802,155 | S | 11/2017 | Cross | |
| D802,782 | S | 11/2017 | Cross | |
| D833,634 | S | 11/2018 | Kramer | |
| D855,820 | S | 8/2019 | Harashima | |
| D870,907 | S | 12/2019 | Cheng | |
| D884,204 | S | 5/2020 | Kramer | |
| D891,631 | S | 7/2020 | Liu | |
| 2002/0022791 | A1 | 2/2002 | Morris et al. | |
| 2003/0009116 | A1 | 1/2003 | Luettgen et al. | |
| 2005/0159687 | A1* | 7/2005 | Mizuuchi | A61H 15/0092 601/73 |
| 2005/0203445 | A1* | 9/2005 | Tsai | A61H 15/02 601/15 |
| 2006/0173389 | A1 | 8/2006 | Chai | |
| 2006/0235343 | A1 | 10/2006 | Fitzmaurice | |
| 2008/0154161 | A1* | 6/2008 | Abbott | A61H 15/0092 601/129 |
| 2013/0096472 | A1 | 4/2013 | Bertram et al. | |
| 2013/0109546 | A1* | 5/2013 | Huang | A61H 7/003 482/115 |
| 2013/0227802 | A1* | 9/2013 | Junkins | B60S 3/048 15/97.1 |
| 2013/0289454 | A1* | 10/2013 | Wang | A61H 15/00 601/132 |
| 2014/0142471 | A1* | 5/2014 | Chambon | A61B 18/203 601/18 |
| 2014/0228722 | A1* | 8/2014 | Nelson | A61H 15/0092 601/125 |
| 2014/0350443 | A1* | 11/2014 | Raines | A61H 15/0092 601/120 |
| 2015/0272847 | A1* | 10/2015 | Wang | A61K 8/42 30/41 |
| 2016/0136033 | A1* | 5/2016 | Johnston | A61H 15/0092 601/129 |
| 2016/0296415 | A1 | 10/2016 | Cross | |
| 2017/0056284 | A1* | 3/2017 | Kramer | A61H 15/0092 |
| 2017/0112710 | A1 | 4/2017 | Johnston | |
| 2020/0246214 | A1 | 8/2020 | Nelson | |
| 2020/0390642 | A1 | 12/2020 | Kim et al. | |

OTHER PUBLICATIONS

Written Opinion dated Feb. 4, 2021 from corresponding International Patent Application No. PCT/US2020/059266, 5 pages.

* cited by examiner

MASSAGE APPARATUS

BACKGROUND OF THE DISCLOSURE

1. Field of the Disclosure

The present disclosure is directed to a massage apparatus, and particularly to a handheld massage apparatus that vibrates and has a plurality of rollers.

2. Description of the Related Art

It is widely accepted that there are therapeutic benefits to massaging the muscles of the human body. Massage therapists undergo extensive training in order to learn to provide effective massages with their hands. Such professionally administered manual massages can be costly.

Over the years, there have been numerous attempts to create machines and devices that simulate manual massages. Such devices employ different massage techniques such as vibration, rolling, suction, and pressure.

SUMMARY OF THE DISCLOSURE

The present disclosure provides a generally u-shaped massage apparatus having three arcuate segments that are expandable to fit around a body part.

The present disclosure provides a vibrating apparatus that has massaging rollers.

The present disclosure further provides a massage apparatus that when positioned around a body part and moved along an axis of the body part, causes one or more rollers to spin and massage the body part.

The present disclosure still further provides a massage apparatus when positioned around a body part is biased against the body part so that one or more rollers spin to massage the body part when the apparatus is moved along an axis of the body part.

The present disclosure provides a massage apparatus that is both portable and configured for self-administration.

The present disclosure provides a simplified massage device having improvements in massage function, portability and cost in view of the prior art.

The above and other objects, features, and advantages of the present disclosure will be apparent and understood by those skilled in the art from the following detailed description, drawings, and accompanying claims. As shown throughout the drawings, like reference numerals designate like or corresponding parts.

DETAILED DESCRIPTION OF THE DISCLOSURE

Figure 1:
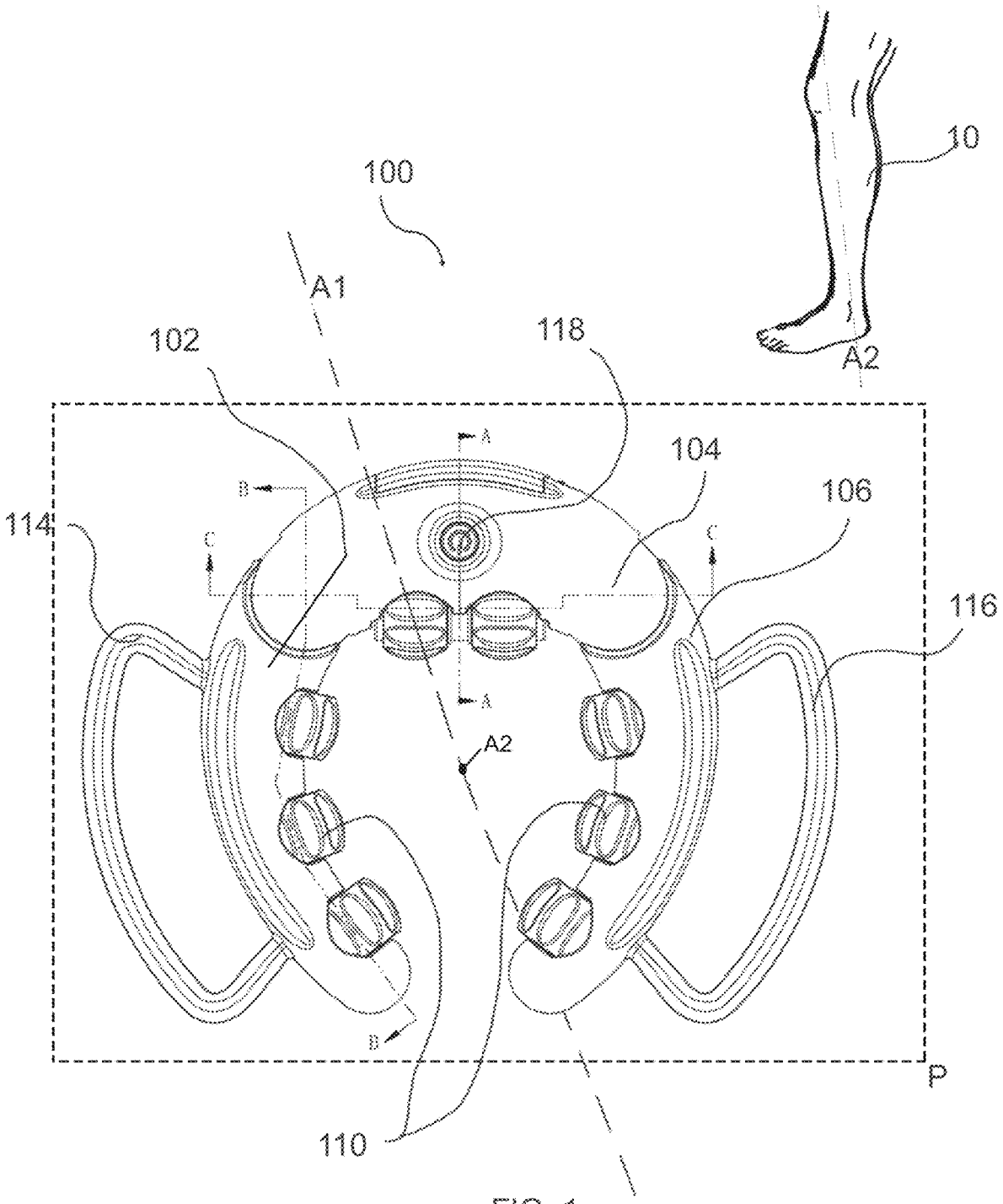
FIG. 1 is a top view of a massage apparatus according to the present disclosure.

Referring to the drawings and, in particular to FIG. 1, a massage apparatus is shown and generally represented by reference numeral 100, hereinafter apparatus or "massager 100".

Figure 2:
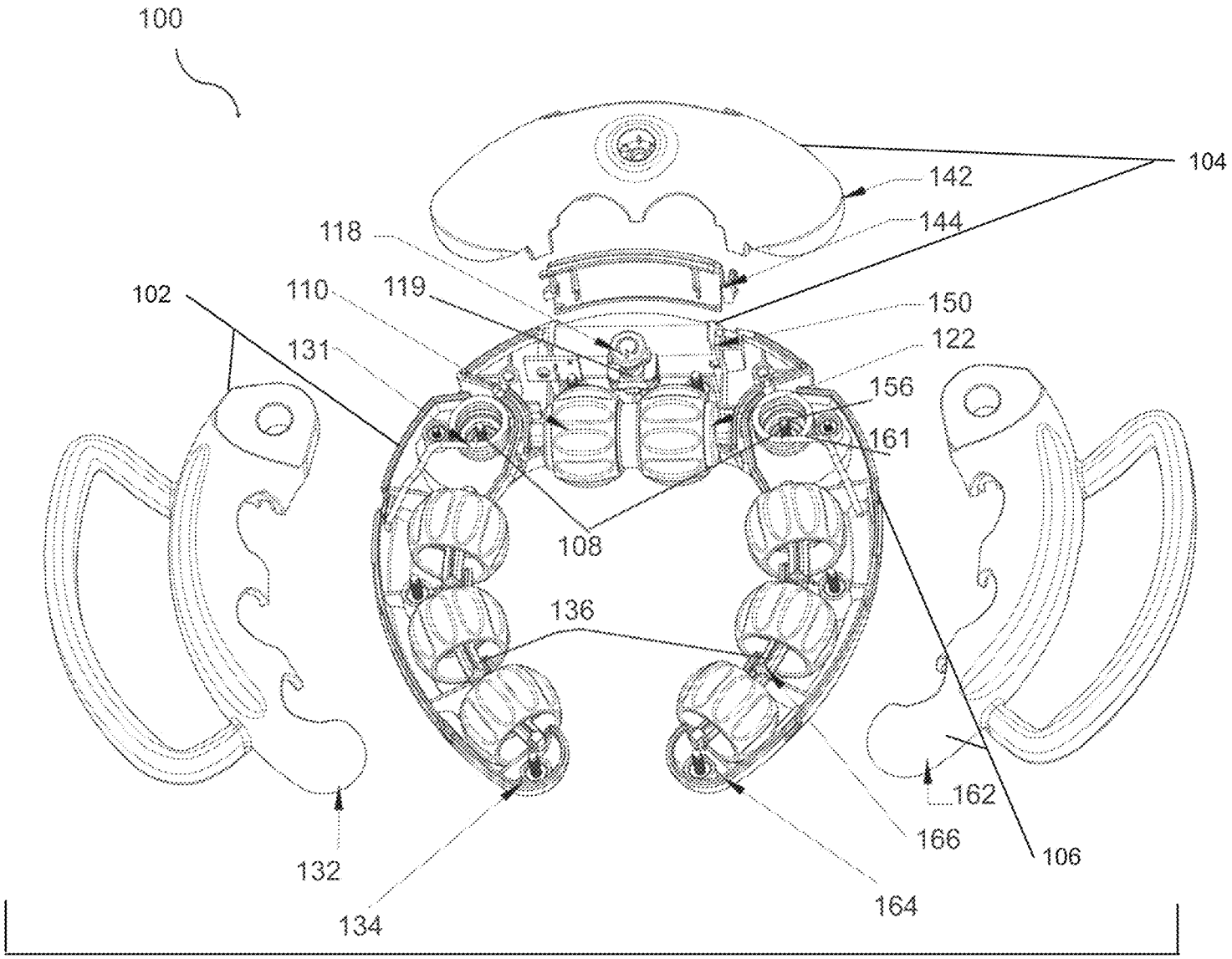
FIG. 2 is partial exploded view of the massage apparatus of FIG. 1.

Massager 100 is a generally u-shaped device composed of three arcuate segments, left segment 102, center segment 104, and right segment 106, connected to each other by spring-loaded hinges 108 shown in FIG. 2, thereby enabling the device to expand to fit around a user's appendage 10. Appendage 10 is an elongate body part having an axis A2 such as, for example, an arm or leg.

The u-shape of massager 100 is disposed in a plane P. Massager 100 has an axis A1 within the u-shape that is normal to plane P and configured to align with axis A2 during use.

Massager 100 includes a plurality of rollers 110 that spin freely. When applied to a body part, rollers 110 improve the function of muscular connective tissue including tendons, ligaments, joint capsules and muscular envelopes In certain embodiments, rollers 110 are constructed of a single material to have a single hardness. In other certain embodiments, rollers 110 are co-molded from two or more materials so as to have a plurality of areas with varying hardness.

Rollers 110 can comprise surface features. Nonlimiting examples include a groove concentric with an axis of rotation, a groove parallel to an axis of rotation, or a groove concentric with an axis of rotation and a groove parallel to an axis of rotation. Other nonlimiting examples include patterns such as horizontal, vertical, radial, circular, and cross-hatched patterns.

Opposed handles 114 and 116 on left segment 102 and right segment 106, respectively, are used to expand massager 100 for positioning on the user's calf muscle. In an expanded state or position, a distance between left segment 102 and axis A1 is greater than a distance between left segment 102 and axis A1 in an unexpanded state. Likewise, in an expanded state or position, a distance between right segment 106 and axis A1 is greater than a distance between right segment 106 and axis A1 in an unexpanded state.

Figure 3:
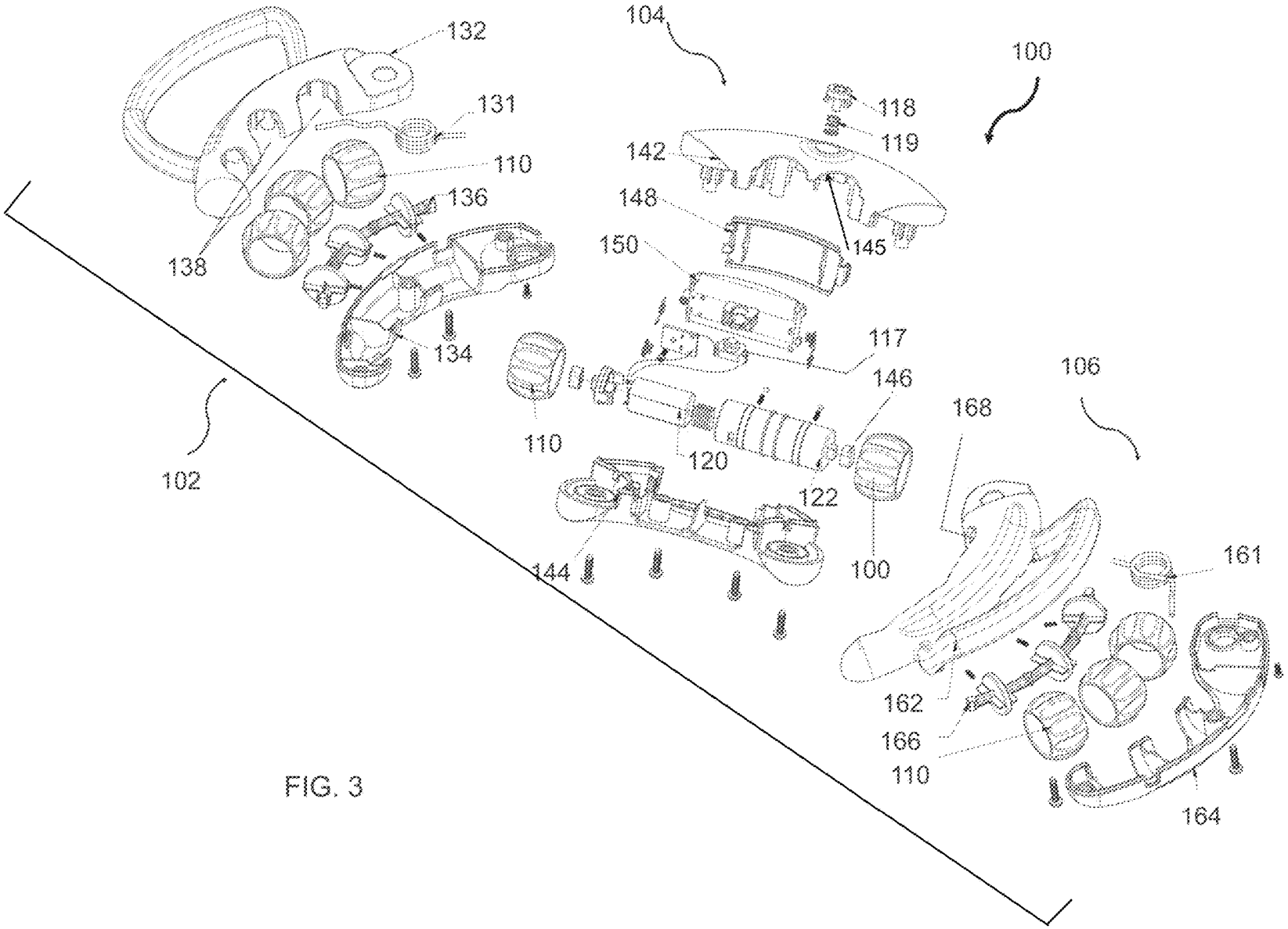
FIG. 3 is full exploded view of the massage apparatus of FIG. 1.

A button 118 toggles a switch in operative communication with a battery-powered vibration producing internal motor, motor 120, shown in FIG. 3, between energized and de-energized states.

Referring now to FIGS. 2 and 3, a partial exploded and full exploded view of the internal components that comprise massager 100 are shown.

Segment 102 includes a bottom housing 134 and a top housing 132 that have a plurality of inward facing openings 138. An arcuate roller axis 136 is positioned between bottom housing 134 and top housing 132. Rollers 110 are disposed on arcuate roller axis 136 and spin freely about the axis. A portion of each roller 110 protrudes from each opening 138 so that the rollers contact the calf when in use. Segment 102 also includes a spring 131 that biases the segment to an unexpanded position from an expanded position.

Segment 106 includes a bottom housing 164 and a top housing 162 that have a plurality of inward facing openings 168. An arcuate roller axis 166 is positioned between bottom housing 162 and top housing 164. Rollers 110 are disposed on arcuate roller axis 166 and spin freely about the axis. A portion of each roller 110 protrudes from each opening 168 so that the rollers contact the calf when in use. Segment 106 also includes a spring 161 that biases the segment to an unexpanded position from an expanded position.

Springs 131 and 161 can be torsion springs acting on the respective segment 102 and 106.

Figure 7B:
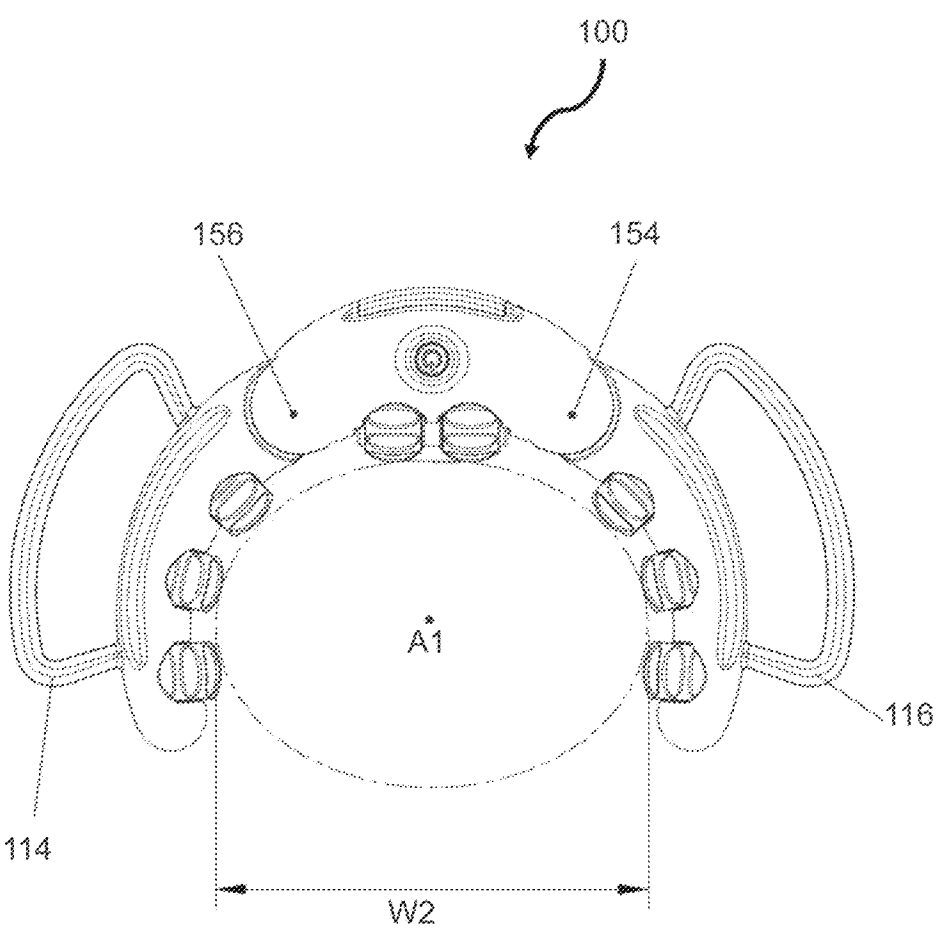
FIG. 7B shows the massage apparatus of FIG. 1 in an expanded position.
Figure 7A:
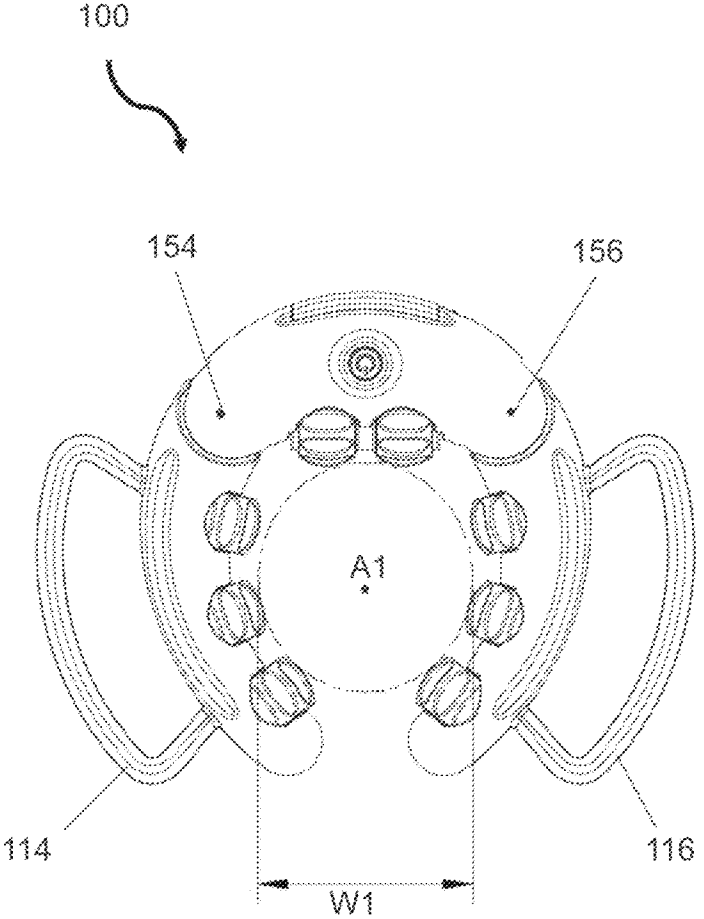
FIG. 7A shows the massage apparatus of FIG. 1 in an unexpanded position.

Segment 102 is joined to segment 106 by segment 104 to form the u-shape, and specifically, as shown in FIGS. 7A and 7B, by hinged joints 154 and 156. Hinged joints 154 and 156 provide single axis rotation normal to plane P shown in FIG. 1.

Segment 104 includes a bottom housing 144 and a top housing 142 with an inward facing opening 145. Segment 104 encloses a motor housing 122 for motor 120. Segment 104 also encloses battery box 150 having positive and negative terminals for connecting a battery 152 (FIG. 4), a switch 117, spring 119 that biases button 118 away from the switch, and circuitry known in the art to provide operative communication with motor 120.

Rollers 110 are rotatably mounted over motor housing 122 on an axis 146. Again, rollers 110 spin freely, and here on axis 146.

Once assembled, battery box 150 can be accessed, for example to install or uninstall a battery, by removing a battery cover 148. Preferably, battery cover 148 is outward facing so as to not interfere with rollers 110.

Figure 4:
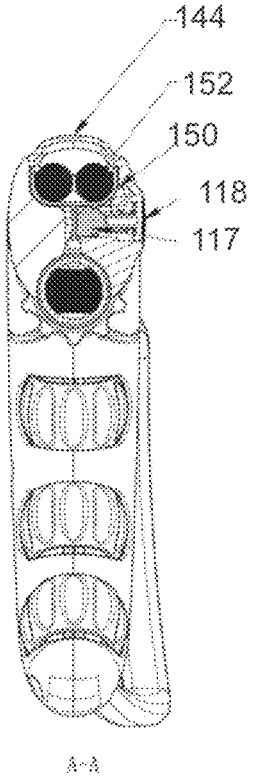
FIG. 4 is a cross section along A-A of FIG. 1.

FIG. 4 is a cross section of FIG. 1 taken along A-A showing battery box 150, switch 117, button 118, and battery cover 148. In battery box 150, there are two batteries 152 shown. Batteries 152 are dry cell batteries known in the art. It is contemplated that other battery types can be used, including non-removable and reachable batteries. Batteries 152 should produce sufficient voltage to power motor 120.

Figure 5:
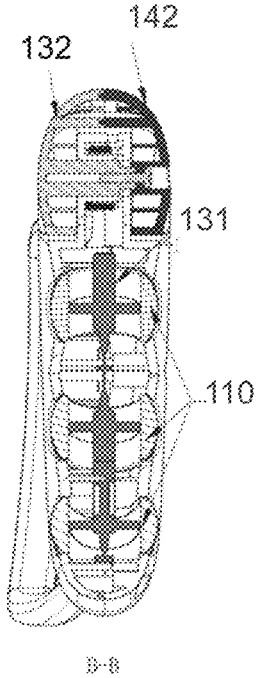
FIG. 5 is a cross section along B-B of FIG. 1.

FIG. 5 is a cross section of FIG. 1 taken along B-B showing bottom housing 134, top housing 132, arcuate roller axis 136 and rollers 110.

Figure 6:
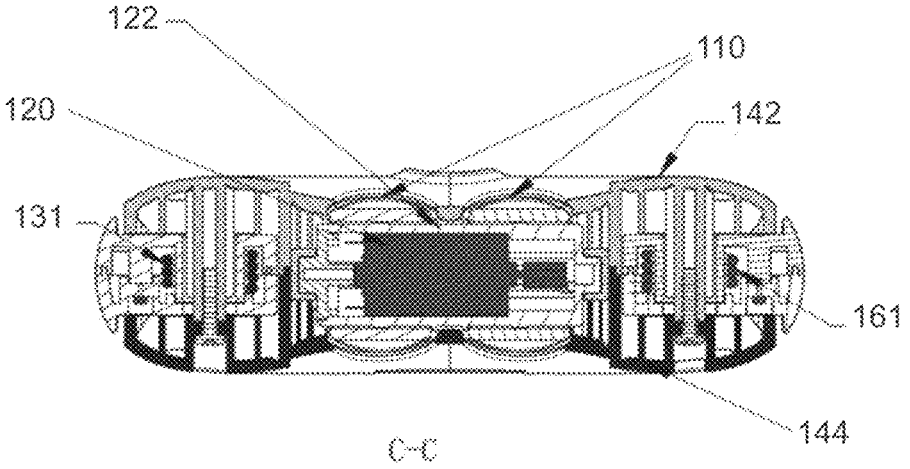
FIG. 6 is a cross section along C-C of FIG. 1.

FIG. 6 is a cross section of FIG. 1 taken along C-C showing bottom housing 144, top housing 142, rollers 110, motor 120, motor housing 122, spring 131 and spring 161.

FIG. 7A shows massager 100 in an unexpanded position having an inner diameter or width W1 and FIG. 7B shows massager 100 in an expanded position having an inner diameter or width W2 that is greater than W1 on the right.

Figure 8:
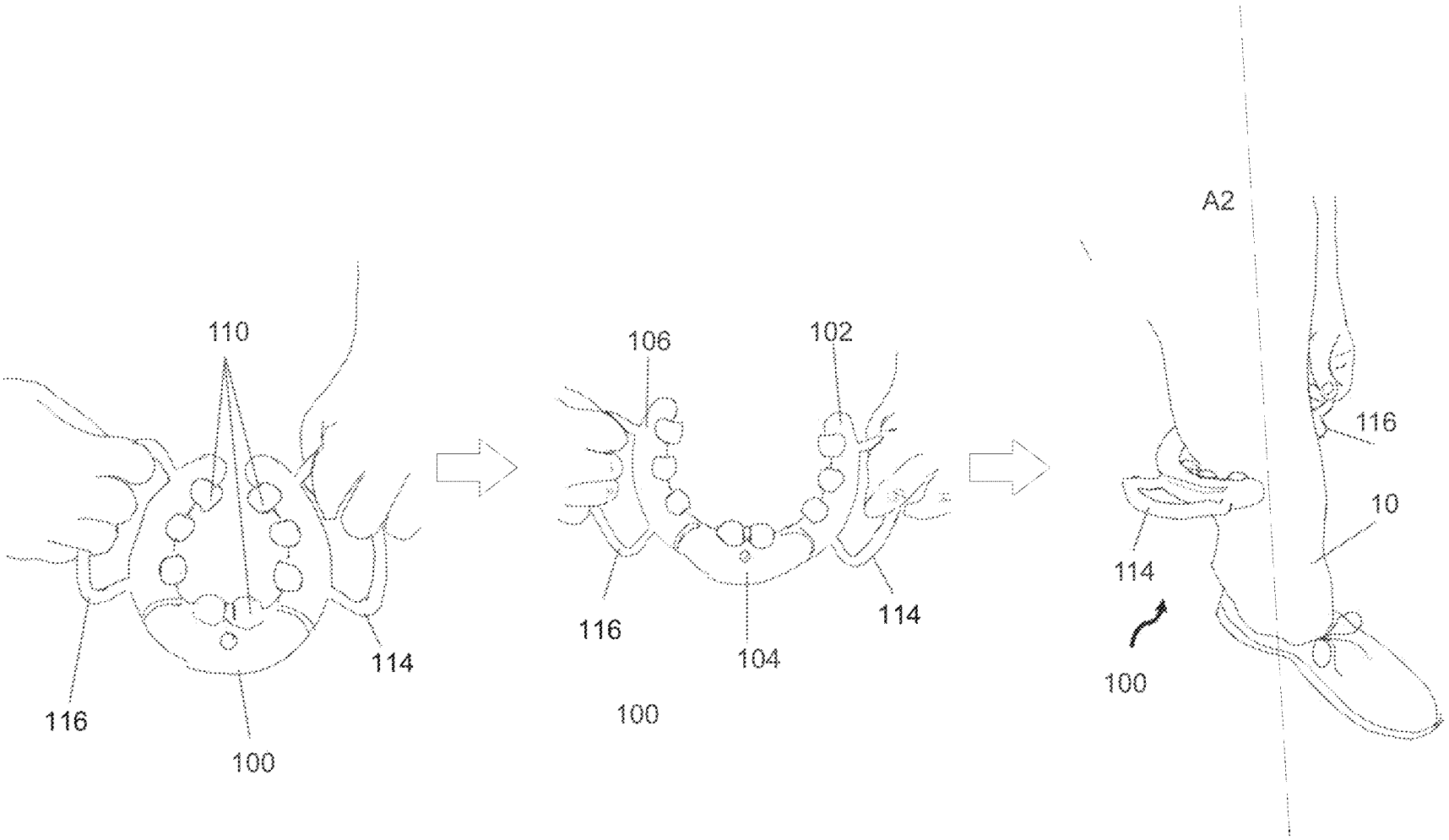
FIG. 8 illustrates the process of expanding the device and locating the device on a body part for use.

Operation of massager 100 will now be described with reference to FIG. 8. A user grasps handles 114 and 116 to pull segments 102 and 106 away from each other. As shown, handles 114 and 116 are closed-loop handles. Segments 102 and 106 each pivot with respect to segment 104 expanding the width from W1 to W2. The user then positions massager 100 around their calf muscle as shown and releases handles 114 and 116 causing segments 102 and 106 to contract around the calf muscle by a force of spring 131 and spring 161 so that rollers 110 contact the calf muscle, and preferably compress the calf muscle. Next, the user powers massager 100 by pressing button 118, thereby causing vibration. Finally, the user moves massager 100 up and down their leg, causing rollers 110 to spin.

Massager 100, by vibrating, can stimulate blood flow, reduce pain, relax the underlying muscles and create a body-wide sense of relaxation in the user. By compressing against the calf, and spinning by movement up and down, rollers cause myofascial release in the calf.

As illustrated and described herein, there are three rollers 110 on segment 102, two rollers on segment 104, and three rollers on segment 106. Other configurations are envisioned. For example, there can be four rollers 110 in segments 102 and 106 and two rollers 110 in segment 104, four rollers 110 in segments 102 and 106 and three rollers 110 in segment 104, three rollers 110 in segments 102 and 106 and three rollers 110 in segment 104, two rollers 110 on segments 102 and 106 and two rollers 110 on segment 104, and other combinations.

The number of rollers 110 that can be included on each segment is dependent on width 111 of the rollers.

Although rollers 110 are shown to be the same width 111, rollers 110 can have different widths.

Preferably rollers 110 each have the same outer diameter.

Motor 120 is a vibration producing motor. A vibration motors typically has an unbalanced mass on its driveshaft. One example of such a motor is an eccentric rotating mass vibration motor (ERM) that use a small unbalanced mass on a DC motor that upon rotation creates a force that translates to vibrations. Another example is a linear resonant actuator (LRA) that includes a small internal mass attached to a spring, creating a vibration force when driven.

In certain embodiments, motor 120 can be driven by Pulse Width Modulation (PWM) to alternates between bursts of "On" and "Off", thereby creating one or more discreet vibrating patterns.

The term "spin freely" means to revolve about an axis up upon application of a rotational force with substantially only frictional forces, and preferably only frictional forces impeding rotation thereof.

Although shown on a user's calf, it should be apparent to those of ordinary skill in the art that massager 100 can be used on other body parts including arms or other portions of the leg, including thigh muscles.

While the present disclosure has been described with reference to one or more exemplary embodiments, it will be understood by those skilled in the art, that various changes can be made, and equivalents can be substituted for elements thereof without departing from the scope of the present disclosure. In addition, many modifications can be made to adapt a particular situation or material to the teachings of the present disclosure without departing from the scope thereof. Therefore, it is intended that the present disclosure will not be limited to the particular embodiments disclosed herein, but that the disclosure will include all aspects falling within the scope of a fair reading of appended claims.

What is claimed is:

1. A massaging apparatus that has both an expanded and an unexpanded state, the massaging apparatus comprising:

a generally U-shaped housing having a first side segment, a second side segment, and a central segment, the first side segment having a connected first side segment end and a free first side segment end, and the second side segment having a connected second side segment end and a free second side segment end, wherein the housing is disposed in a plane, wherein the housing has a housing axis that is normal to the plane and configured to align with an appendage axis of a user, wherein the connected first side segment end of the first side segment and the connected second side segment end of the second side segment are each pivotably connected to the central segment, wherein the central segment encloses a vibration producing motor, wherein the first side segment, the second side segment, and the central segment each has at least one opening that faces the housing axis; and a plurality of rollers that are each disposed in one of the at least one opening of the first side segment, the second side segment, and the central segment, wherein the first side segment and the second side segment are each pivotably connected to the central segment and can rotate relative to each other in order to expand for positioning on a single user's calf muscle, and wherein the central segment, the first side segment and the second side segment are sized to position one or more of the plurality of rollers positioned in the at least one opening of the central segment against the single user's calf muscle and maintain a space between the free first side segment end of the first side segment and the free second side segment end of the second side segment while positioned on the single user's calf muscle, the first side segment having a first handle that extends from adjacent the connected first side segment end to adjacent to the first free side segment end, the second side segment having a second handle that extends from adjacent the connected second side segment end to adjacent to the free second side segment end.

2. The apparatus of claim 1, further comprising a first torsion spring connecting the first side segment to the central segment and a second torsion spring connecting the second side segment to the central segment so as to bias the first side segment and the second side segment towards the axis when the housing is in an expanded state.

3. The apparatus of claim 2, further comprising a rechargeable battery.

4. The apparatus of claim 1, further comprising circuitry configured to energize and de-energize the vibrating motor.

5. The apparatus of claim 1, wherein the plurality of rollers each spins freely.

6. The apparatus of claim 1, wherein the first side segment comprises an identical number of rollers in the plurality of rollers as the second side segment.

7. The apparatus of claim 1, wherein the plurality of rollers each comprises a surface feature selected from the group consisting of: a texture, an indentation, a projection, and a groove.

8. The apparatus of claim 1, wherein the plurality of rollers comprises a material having a first density and a second material having a second density that is less than the first density.

9. A massaging apparatus that has both an expanded and an unexpanded state, the massaging apparatus comprising:

a generally U-shaped housing having a first side segment, a second side segment, and a central segment, each of the first side segment and the second side segment being pivotably connected to the central segment, the first side segment, the second side segment, and the central segment each having at least one opening, the first side segment having a connected first side segment end and a free first side segment end, and the second side segment having a connected second side segment end and a free second side segment end, the first side segment and the second side segment are each pivotably connected to the central segment and can rotate relative to each other in order to expand for positioning on a single user's calf muscle, the first side segment having a first handle that extends from adjacent the connected first side segment end to adjacent to the free first side segment end, the second side segment having a second handle that extends from adjacent the connected second side segment end to adjacent to the free second side segment end; and a plurality of rollers that are each disposed in one of the at least one opening of the first side segment, the second side segment, and the central segment, the central segment having at least two openings with at least two of the plurality of rollers being disposed in the at least two openings of the central segment, the at least two of the plurality of rollers of the central segment being aligned on a single, parallel axis of rotation, and the central segment enclosing a vibration producing motor so that the at least two of the plurality of rollers are mounted over a housing of the vibration producing motor, wherein the central segment, the first side segment and the second side segment are sized to position one or more of the plurality of rollers positioned in the at least one opening of the central segment against the single one of user's calf muscles, and wherein the combined points of contact by the plurality of rollers of the first side segment, the second side segment, and the central segment cover a range of greater than 180 degrees.

* * * * *